US005746230A

United States Patent [19]

Arterbery et al.

[11] Patent Number: 5,746,230

[45] Date of Patent: *May 5, 1998

[54] CONCENTRIC SMOKING FILTER HAVING DISCRETE TOW AND WEB FILTER MEDIA

[75] Inventors: Cynthia W. Arterbery, Chesterfield; W. Timothy Callaham, Richmond; Gus D. Keritsis, Richmond; Morris F. White, Jr., Richmond, all of Va.

[73] Assignee: Philip Morris Incorporated, New York, N.Y.

[ * ] Notice: The term of this patent shall not extend beyond the expiration date of Pat. No. 5,365,951.

[21] Appl. No.: 456,003

[22] Filed: May 31, 1995

Related U.S. Application Data

[63] Continuation of Ser. No. 118,575, Sep. 8, 1993, abandoned, which is a continuation of Ser. No. 796,631, Nov. 22, 1991, abandoned, which is a continuation-in-part of Ser. No. 571,878, Aug. 24, 1990, abandoned.

[51] Int. Cl.[6] ..... A24D 3/02; A24D 3/06

[52] U.S. Cl. ..... 131/331; 131/336; 131/340

[58] Field of Search ..... 131/331, 336, 131/338, 339, 344, 345

[56] References Cited

U.S. PATENT DOCUMENTS

| | | | |
|---|---|---|---|
| 1,993,728 | 3/1935 | Aivaz | 93/1 |
| 2,793,572 | 5/1957 | Parmele | 93/1 |
| 3,128,680 | 4/1964 | Schaaf | 93/1 |
| 3,313,306 | 4/1967 | Berger et al. | 131/10.7 |
| 3,348,553 | 10/1967 | Huber | 131/194 |
| 3,396,061 | 8/1968 | Browne | 156/178 |
| 3,579,623 | 5/1971 | Thomson et al. | 264/135 |
| 3,733,246 | 5/1973 | Thomson et al. | 161/176 |
| 4,022,221 | 5/1977 | Berger | 131/10.5 |
| 4,022,222 | 5/1977 | Berger | 131/10.5 |
| 4,026,306 | 5/1977 | Berger | 131/10.5 |
| 4,034,765 | 7/1977 | Hall | 131/10 A |
| 4,046,063 | 9/1977 | Berger | 93/1 C |
| 4,064,791 | 12/1977 | Berger | 93/1 C |
| 4,082,098 | 4/1978 | Owens, Jr. | 131/274 |
| 4,088,065 | 5/1978 | Hall | 93/1 C |
| 4,149,550 | 4/1979 | Green et al. | 131/266 |
| 4,166,090 | 8/1979 | Green et al. | 264/25 |
| 4,173,504 | 11/1979 | Tomioka et al. | 156/180 |
| 4,261,373 | 4/1981 | Tamaoki et al. | 131/332 |
| 4,291,711 | 9/1981 | Berger | 131/336 |
| 4,292,984 | 10/1981 | Sawanda et al. . | |
| 4,411,641 | 10/1983 | Suzuki et al. | 493/46 |
| 4,661,132 | 4/1987 | Thornton et al. | 55/486 |
| 4,661,255 | 4/1987 | Aumann et al. | 210/491 |
| 4,700,723 | 10/1987 | Yoshikawa et al. | 131/334 |
| 4,731,135 | 3/1988 | Tani et al. | 156/62.6 |
| 4,752,348 | 6/1988 | Bryant et al. | 156/201 |
| 4,808,202 | 2/1989 | Nishikawa et al. | 55/390 |
| 4,865,055 | 9/1989 | Belvederi | 131/331 |
| 4,874,004 | 10/1989 | Borowski et al. | 131/364 |
| 5,107,863 | 4/1992 | Nyffeler et al. . | |
| 5,115,823 | 5/1992 | Keritisis | 131/336 |

FOREIGN PATENT DOCUMENTS

| | | | |
|---|---|---|---|
| 2007022 | 7/1990 | Canada . | |
| 474940 | 12/1990 | European Pat. Off. | A24D 3/04 |
| 1324235 | 11/1961 | France . | |
| 1531543 | 7/1968 | France . | |

(List continued on next page.)

OTHER PUBLICATIONS

Hartog et al., "An Alkaline Phosphatase from Thermus sp Strain Rt41A," *Int. J. Biochem.* 24:1657–1660 (1992).

(List continued on next page.)

*Primary Examiner*—William M. Pierce
*Attorney, Agent, or Firm*—James T. Moore; James E. Schardt; Charles E. B. Glenn

[57] ABSTRACT

A concentric smoking filter in which one of the filter media is a fibrous tow, such as fibrous cellulose acetate tow, and one of the filter media is a web material, such as paper, is provided. The filter improves the taste, particularly, of "ultra-light" cigarettes.

41 Claims, 3 Drawing Sheets

FOREIGN PATENT DOCUMENTS

| | | | |
|---|---|---|---|
| 58-32587 | 2/1976 | Japan | A24D 3/16 |
| 61-20265 | 5/1978 | Japan . | |
| 58-6467 | 4/1979 | Japan | A24D 3/04 |
| 61-12674 | 8/1984 | Japan | A24D 3/04 |
| 4-53507 | 11/1984 | Japan | A24D 3/04 |
| 59-13181 | 11/1984 | Japan | A24D 3/02 |
| 60-35424 | 3/1985 | Japan | A24D 3/04 |
| 4-74995 | 11/1985 | Japan | A24D 3/04 |
| 62-19196 | 2/1986 | Japan | A24D 3/04 |
| 62-19197 | 2/1986 | Japan | A24D 3/04 |
| 1397367 | 6/1975 | United Kingdom . | |
| 2012554 | 8/1979 | United Kingdom . | |
| 1592952 | 7/1981 | United Kingdom . | |
| 2113066 | 8/1983 | United Kingdom . | |
| 2119221 | 11/1983 | United Kingdom . | |
| WO9009741 | 9/1990 | WIPO . | |

OTHER PUBLICATIONS

Holgrem et al., "Catalytic Properties and Stability of Three Common Variants of Placental Alkaline Phosphatase," *Medline Asseccion No. 79103184, Biochem Gent.* 16:433–442 (1978).

Huber et al., "Metallsphaera sedula gen. and sp. Nov. Represents a Genus of Aerobic, Metal–Mobilizing, Thermoacidophilic Archaebacteria," *System Appl. Microbiol.* 12:38–47 (1989).

Hulett–Cowling and Campbell, "Purification and Properties of an Alkaline Phosphatase of *Bacillus licheniformis,*" *Biochemistry* 10:1364–1371 (1971).

Kam etal., "Cloning, Sequencing and Chromosomal Localization of Human Term Placental Alkaline Phosphatase cDNA," *Proc. Natl. Acad. Sci. USA* 82:8715–8719 (1985).

Schaffel et al., "Alkaline Phosphatase from *Bacillus licheniformis,*" *Biochem. Biophys. Acta* 526:157–467 (1978).

Yeh and Trela, "Purification and Characterization of a Repressible Alkaline Phosphatase from *Thermus aquaticus,*" *J. Biol. Chem.* 251:3134–3139 (1976).

CONCENTRIC SMOKING FILTER HAVING DISCRETE TOW AND WEB FILTER MEDIA

CROSS REFERENCE TO RELATED APPLICATION

This is a file wrapper continuation of Ser. No. 08/118,575, filed Sep. 8, 1993, which is hereby abandoned and which in turn is a continuation of Ser. No. 07/796,631, filed Nov. 22, 1991, which is abandoned and which in turn is continuation-in-part of Ser. No. 07/571,878, filed Aug. 24, 1990, which is abandoned.

BACKGROUND OF THE INVENTION

This invention relates to smoking filters, and particularly to concentric smoking filters. More particularly, this invention relates to concentric smoking filters having tow and web filter media portions arranged concentrically.

Most smoking filters, particularly cigarette filters, sold commercially as part of cigarettes consist of a cylindrical rod or "plug" of a "tow" of plasticized cellulose acetate fibers. Some filters are variants of the standard filter, having recessed mouth ends, or being made of two plugs placed end-to-end with a space in between, the space being either empty or filled with another material such as charcoal. It is also known to provide such filters having multiple plugs abutting one another, the different plugs differing in density or other characteristics.

Similarly, it is known to provide filtering media other than cellulose acetate. One such medium is an appropriate sheet or web material. The web material, which is gathered into a cylindrical plug, can be paper or any other web material, including cellulose acetate in sheet form. When such web materials are used as filters, they are frequently corrugated before being gathered. Paper webs may also be creped to improve tensile strength.

Some of these different materials and different constructions have been combined. For example, it is known to provide filters having two or more abutting plugs, at least one of which is cellulose acetate tow, and at least one of which is a web material.

Finally, it is known to provide "concentric filters" in which two different forms of cellulose acetate tow—differing, e.g., in density—are formed in to a filter. One cellulose acetate tow forms a cylindrical "core", while the other tow forms an annular peripheral layer.

Smoking filters are characterized by various parameters, including pressure drop, which is referred to as resistance-to-draw ("RTD") and usually measured as the height of a column of water, and efficiency, which is measured as the percentage of the total particulate matter ("TPM") in the unfiltered smokestream that is trapped by the filter. The RTD of a filter affects how smokers perceive the filter in terms of how hard they must draw on it to receive a desired amount of smoke, while the filter efficiency controls the amount of TPM delivered in the smoke.

It has been found that while web filters, and particularly paper filters, are more efficient than tow filters, the web material, especially paper, adds an off taste to the smoke which decreases smoker satisfaction. In addition, the appearance of the visible deposited smoke components on the end of a paper filter is much less regular, and more spotty, than on a cellulose acetate tow filter, again affecting the aesthetic impact on the smoker. This difference in appearance is believed to result from the channelling of deposited material in the channels formed by the corrugation and gathering of the web during plug making.

As consumer preferences tend toward lower delivery cigarettes, the need for higher efficiency filters, which allow lower delivery without increased filter RTD, increases. However, the higher efficiency of paper filters could not previously be taken advantage of because of the negative consumer impacts of paper filters.

It would be desirable to be able to provide a high efficiency filter which produced low delivery while also delivering acceptable taste, RTD and other aesthetic impacts.

SUMMARY OF THE INVENTION

It is an object of this invention to provide a high efficiency filter which produces low delivery while also delivering acceptable taste, RTD and other aesthetic impacts.

In accordance with this invention, there is provided a smoking filter comprising a first filter plug having a central core of a first filter material and a peripheral layer of a second filter material surrounding the central core. One of the first and second filter materials is cellulose acetate tow and the other of the first and second filter materials is a gathered corrugated web material. Each of the central core and the peripheral layer has a resistance-to-draw, the central core having a resistance-to-draw of between about 285 mm W.G. and about 500 mm W.G. and the filter having a resistance-to-draw of between about 115 mm W.G. and about 225 mm W.G. The peripheral layer has a lower resistance-to-draw than the central core, to initially direct, when the filter is attached to a smoking article and the smoking article is smoked, a greater fraction of smoke through the peripheral layer than through the central core. The first filter plug further has means for admitting ventilation air into the peripheral layer, whereby smoke initially directed into the peripheral layer flows back into the central core, whereby when the filter is attached to a smoking article and the smoking article is smoked, the filtered smoking article delivers smoke containing a particular level of total particulate matter, and the taste of the smoking article is a taste associated with smoke having a level of total particulate matter higher than that particular level.

A dual filter including the first filter plug and a conventional second filter plug is also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

In accordance with the present invention, it has unexpectedly been found that when a concentric filter is made with paper or other web material in the core, and cellulose acetate tow in the periphery, or vice-versa, not only is high filtration efficiency achieved without the introduction of an off taste from the paper, but a cigarette with low TPM delivery can be produced which has the taste of a cigarette with a higher TPM delivery.

Figure 1:
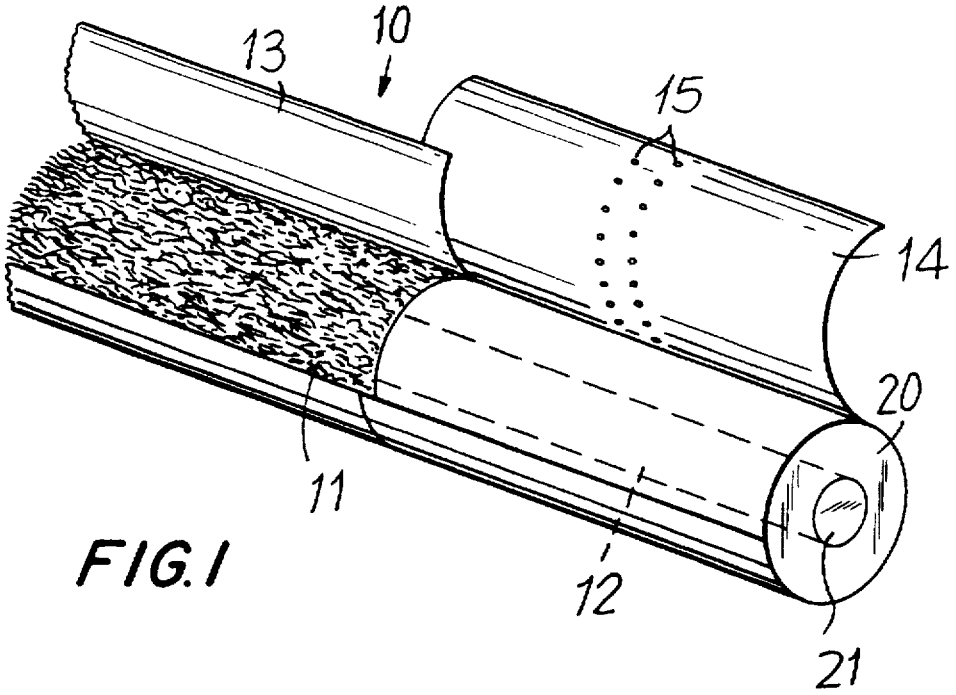
FIG. 1 is a mouth end perspective view of a cigarette having a first embodiment of a filter according to the present invention.
Figure 2:
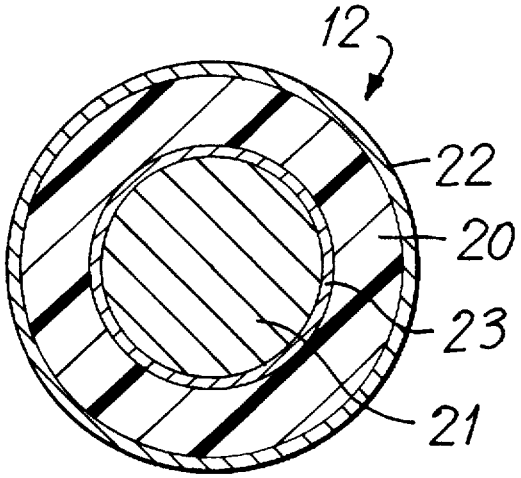
FIG. 2 is a radial cross-sectional view of the filter of FIG. 1.

As shown in FIGS. 1 and 2, cigarette 10 includes a tobacco rod 11 and a first preferred embodiment of a filter 12 according to this invention. Tobacco rod 11 is wrapped in conventional wrapper 13, while filter 12 is wrapped by conventional tipping 14. Filter 12 includes cellulose acetate tow peripheral layer 20 and central paper core 21. Cellulose acetate peripheral layer 20 is a conventional cellulose acetate tow, preferably wrapped by porous plug wrap 22, although self-supporting filter rod technology, such as steam bonding or spray coating of the outer surface of peripheral layer 20, can be used to make a filter that need not be wrapped, if desired. Paper core 21 is a paper web that has been corrugated and gathered into cylindrical form and wrapped with plug wrap paper 23.

Plug wrap 23 improves the processibility of core 21 as well as its aesthetic appearance, and also helps to assure substantially perfect concentricity. Flavorants or other additives, such as soluble tobacco components, could be applied to plug wrap 23 to enhance the subjective impact of the filtered smoke. A similar result might be achieved by forming plug wrap 23 from a tobacco-containing material, such as reconstituted tobacco sheet. Plug wrap 23 is preferably porous, to allow smoke and air to freely move radially between peripheral layer 20 and core 21. At the same time, the presence of plug wrap 23 helps prevent channelling of smoke along the interface between peripheral layer 20 and core 21.

The most preferred embodiment of filter 12 has a circumference of about 24.45 mm and an average weight of about 258 mg. The cross-sectional area of core 21 preferably makes up about 60% of the total cross-sectional area of filter 12. Filter 12 preferably has an RTD of between about 110 mm W.G. and about 230 mm W.G., with the RTD of central core 21 being between about 300 mm W.G. and about 500 mm W.G.. More preferably, filter 12 has an RTD of about 146 mm W.G., with the RTD of central core 21 being about 400 mm W.G.

In the particularly preferred embodiment, the cellulose acetate tow of peripheral layer 20 is preferably an 8.0/30000 cellulose acetate tow having a denier per fiber of 8, a total denier of 30,000, and a "Y" cross-sectional shape. The web of core 21 is preferably a 100% cellulose semi-creped softwood pulp paper with 10% crosswise creping for added tensile strength. Such a paper is available from Tela Papierfabrik AG, of Balsthal, Switzerland.

Cigarette 10 is preferably ventilated to between about 50% and about 75% ventilation, and more preferably about 67% ventilation, with appropriate ventilation holes 15 provided in tipping 14. If the surface of filter 12 is not air permeable, appropriate holes would also be provided in filter 12.

Figure 3:
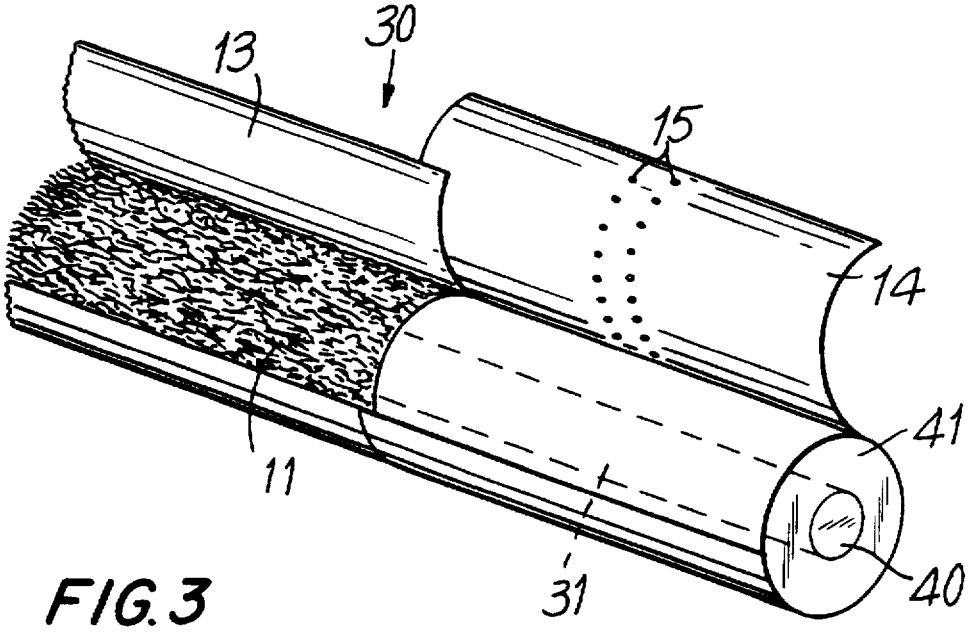
FIG. 3 is a mouth end perspective view of a cigarette having a second embodiment of a filter according to the present invention.
Figure 4:
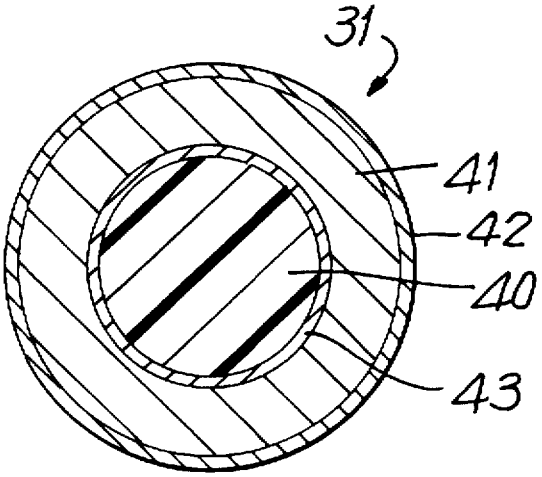
FIG. 4 is a radial cross-sectional view of the filter of FIG. 3.

FIGS. 3 and 4 show a cigarette 30 having a second preferred embodiment of filter 31 similar in construction to filter 12, except that core 40 is a tow material and peripheral layer 41 is a web material.

Similarly, in this embodiment plug wrap 42 is necessary to contain the web material of peripheral layer 41, while plug wrap or other permeable wrap 43 around tow core 40 is optional, as tow core 40 could be made using self-supporting filter rod technology, as above.

The most preferred embodiment of filter 31 has a circumference of about 24.45 mm and an average weight of about 240 mg. The cross-sectional area of core 40 preferably makes up about 60% of the total cross-sectional area of filter 31. Filter 31 preferably has an RTD of between about 165 mm W.G. and about 195 mm W.G., with the RTD of central core 40 being between about 285 mm W.G. and about 385 mm W.G. More preferably, filter 31 has an RTD of about 182 mm W.G., with the RTD of central core 40 being about 334 mm W.G.

In this embodiment, the cellulose acetate tow of core 40 is preferably a 1.6/35000 cellulose acetate tow having a denier per fiber of 1.6, a total denier of 35,000, and a "Y" cross-sectional shape. The web of peripheral layer 41 is preferably the same 100% cellulose semi-creped softwood pulp paper, with 10% crosswise creping for added tensile strength, that is used in core 21 of filter 12.

Cigarette 30 is preferably ventilated to between about 50% and about 75% ventilation, and more preferably about 67% ventilation, with appropriate ventilation holes 15 provided in tipping 14, as in cigarette 10.

Figure 5:
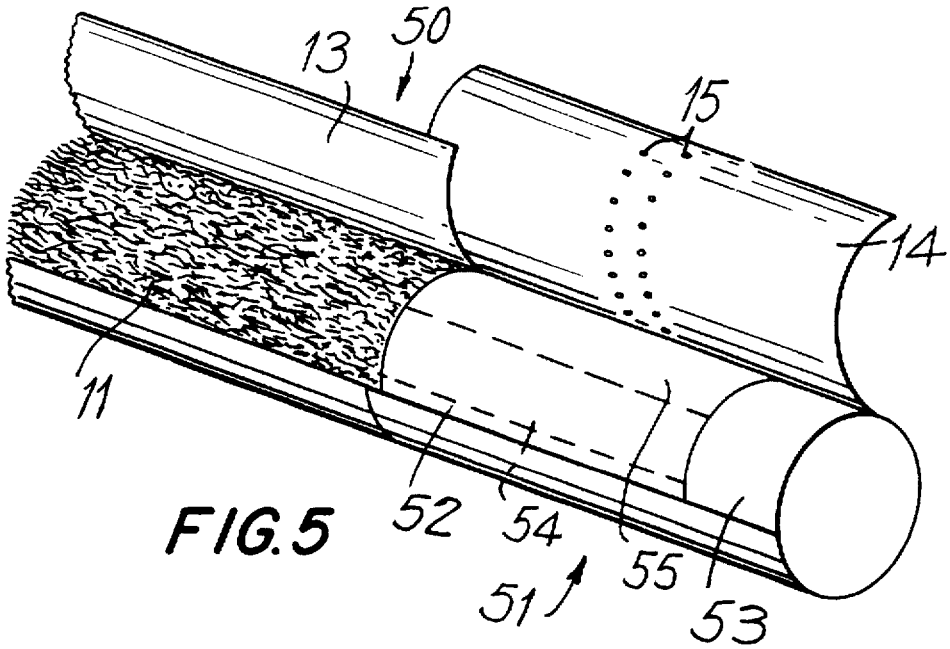
FIG. 5 is a mouth end perspective view of a cigarette having a third embodiment of a filter according to the present invention.

FIG. 5 shows a cigarette 50 having a third preferred embodiment of a filter 51 according to the invention. Filter 51 is a so-called "dual" filter, made up of two abutting filter segments 52, 53. Filter segment 52, which is adjacent tobacco rod 11, is a concentric filter as discussed above, in which one of core 54 and peripheral layer 55 is of a web material and the other of core 54 and peripheral layer 55 is of a tow material. Filter segment 53, which is at the mouth end, is a conventional tow filter, such as a cellulose acetate filter, and is provided primarily for cosmetic purposes. Nevertheless, segment 53 has filtration and RTD characteristics, and segment 52 must be adjusted so that the overall filter 51 has the desired characteristics.

In a preferred form of this embodiment, segment 52 is constructed like filter 12, but has a length of only 18–20 mm, while segment 53 is a 7–9 mm long plug of 8.0/40000 cellulose acetate for tow having a denier per fiber of 8.0, a total denier of 40,000, and a "Y" cross-sectional shape. Total filter RTD is between about 100 mm W.G. and about 180 mm W.G., preferably about 159 mm W.G. The RTD of segment 53 is between about 10 mm W.G. and about 45 mm W.G., preferably about 18 mm W.G. The RTD of segment 52 is between about 85 mm W.G. and about 175 mm W.G., preferably about 141 mm W.G. The RTD of the paper core 54 of segment 52 is between about 195 mm W.G. and about 450 mm W.G., preferably about 267 mm. W.G. Cigarette 50 made with this embodiment of filter 51 is ventilated to between about 50% and about 75% ventilation, preferably about 71% ventilation, with appropriate ventilation holes 15 in tipping 14.

Figure 6:
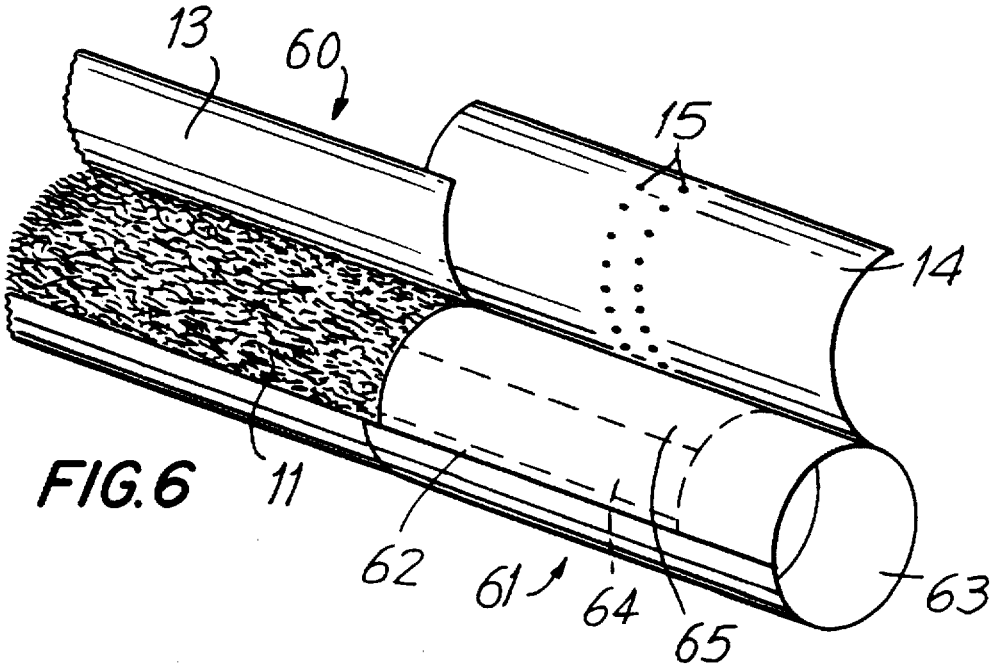
FIG. 6 is a mouth end perspective view of a cigarette having a fourth embodiment of a filter according to the present invention.

FIG. 6 shows a cigarette 60 having a fourth embodiment of a filter 61 according to the invention. Filter 61 is a recessed filter, made up of filter segment 62 recessed into tipping 14 at 63. Filter segment 62, which is adjacent tobacco rod 11, is a concentric filter as discussed above, in which one of core 64 and peripheral layer 65 is of a web material and the other of core 64 and peripheral layer 65 is of a tow material.

The filter parameters discussed herein are valid for 85 mm and 100 mm cigarettes. It is to be understood that filters according to the present invention can also be used with longer cigarettes. If a longer cigarette is provided, the filter parameters would have to be adjusted, in accordance with the knowledge of those skilled in the art.

EXAMPLE I

A filter according to the most preferred embodiment discussed above in connection with FIGS. 1 and 2, except that the tow in the peripheral layer was an 8.0/25000 cellulose acetate tow having a denier per fiber of 8.0 and a total denier of 25000, was prepared and mated to an "ultra-light" king-size tobacco rod having the following characteristics:

| | |
|---|---|
| Tobacca | 487 mg |
| Total RTD | 107 mm W.G. |
| Filter RTD | 146 mm W.G. |
| Ventilation | |
| Tipping length | 32.0 mm |

The cigarette was smoked in a smoking machine under FTC conditions with the following results:

| | |
|---|---|
| TPM | 1.8 mg |
| Nicotine | 0.16 mg |
| Water | 0.21 mg |
| "Tar" | 1.5 mg |
| Puff Count | 6.2 |

The cigarette, which generates 1.5 mg of "tar", was also smoked by expert smokers, who reported that the cigarette had the taste of a cigarette that generates 4–5 mg of "tar". At 67% ventilation, the filter has an efficiency of about 76%. If there had been no ventilation, the efficiency would have been about 61%.

The cigarette also exhibited a pattern of visible deposition of filtrate on the end of the filter much more like a tow filter as opposed to a web filter, even though most of the filtrate was deposited on the web core. This is believed to be the result of the smoke being forced into core 21 as the ventilation air is introduced at holes 15, and then trying to spread back into peripheral tow layer 20 through permeable wrapper 23.

EXAMPLE II

A filter according to the preferred form of the embodiment of FIG. 5 was prepared and mated to an "ultra-light" king-size tobacco rod having the following characteristics:

| | |
|---|---|
| Tobacca | 429 mg |
| Total RTD | 93 mm W.G. |
| Filter RTD | 159 mm W.G. |
| Ventilatian | 71% |
| Tipping length | 32 min |

The cigarette was smoked in a smoking machine under FTC conditions with the following results:

| | |
|---|---|
| TPM | 1.6 mg |
| Nicotine | 0.13 mg |
| Water | 0.10 mg |
| "Tar" | 1.4 mg |
| Puff Count | 5.3 |

As in the case of Example I, this cigarette was smoked by expert smokers who reported that the cigarette had the taste of a cigarette that generates 4–5 mg of "tar".

EXAMPLE III

A filter according to the preferred form of the embodiment of FIG. 5 was prepared and mated to an "ultra-light" king-size tobacco rod having the following characteristics:

| | |
|---|---|
| Tobacco | 485 mg |
| Total RTD | 101 mm W.G. |
| Filter RTD | 172 mm W.G. |
| Ventilation | 66% |
| Tipping length | 32 mm |

The cigarette was smoked in a smoking machine under FTC conditions with the following results:

| | |
|---|---|
| TPM | 1.4 mg |
| Nicotine | 0.12 mg |
| Water | 0.17 mg |
| "Tar" | 1.1 mg |
| Puff Count | 6.1 |

As in the case of Examples I and II, this cigarette was smoked by expert smokers who reported that the cigarette had the taste of a cigarette that generates 4–5 mg of "tar".

EXAMPLE IV

A filter according to the preferred form of the embodiment of FIG. 5 was prepared and mated to an "ultra-light" tobacco rod of a length used for 100 mm cigarettes and having the following characteristics:

| | |
|---|---|
| Tobacco | 602 mg |
| Total RTD | 106 mm W.G. |
| Filter RTD | 140 mm W.G |
| Ventiletion | 60% |
| Tipping length | 32 mm |

The cigarette was smoked in a smoking machine under FTC conditions with the following results:

| | |
|---|---|
| TPM | 2.9 mg |
| Nicotine | 0.22 mg |
| Water | 0.20 mg |
| "Tar" | 2.5 mg |
| Puff Count | 7.5 |

As in the case of Examples I–III, this cigarette was smoked by expert smokers who reported that the cigarette had the taste of a cigarette that generates 4–5 mg of "tar".

EXAMPLE V

A filter according to the preferred form of the embodiment of FIG. 5 is prepared and mated to an "ultra-light" king-size tobacco rod having the following characteristics:

| | |
|---|---|
| Tobacca | 472 mg |
| Totat RTD | 106 mm W.G. |
| Fiter RTD | 142 mm W.G. |
| Ventilation | 55% |
| Tipping length | 32 mm |

The cigarette is smoked in a smoking machine under FTC conditions with the following results:

| | |
|---|---|
| TPM | 3.5 mg |
| Nicotine | 0.21 mg |
| Water | 0.26 mg |
| "Tar" | 3.0 mg |
| Puff Count | 6.1 |

This cigarette is smoked by expert smokers who report that the cigarette has the taste of a cigarette that generates 6–7 mg of "tar".

EXAMPLE VI

A filter according to the preferred form of the embodiment of FIG. 5 is prepared and mated to an "ultra-light" tobacco rod of a length used for 100 mm cigarettes and having the following characteristics:

| | |
|---|---|
| Tobacco | 604 mg |
| Total RTD | 106 mm W.G. |
| Filter RTD | 127 mm W.G. |
| Ventilation | 50% |
| Tipping length | 32 mm |

The cigarette is smoked in a smoking machine under FTC conditions with the following results:

| | |
|---|---|
| TPM | 4.9 mg |
| Nicotine | 0.33 mg |
| Water | 0.36 mg |
| "Tar" | 4.2 mg |
| Puff Count | 7.3 |

As in the case of Example V, this cigarette is smoked by expert smokers who report that the cigarette has the taste of a cigarette that generates 6–7 mg of "tar".

The filter of this invention will improve the taste of low delivery cigarettes. It is also possible that the filter of this invention may offer similar performance at higher deliveries. For example, a medium delivery cigarette may be perceived as a full-flavor cigarette.

Thus it is seen that a high efficiency filter which produces low delivery while also delivering acceptable taste and other aesthetic impacts is provided. One skilled in the art will appreciate that the present invention can be practiced by other than the described embodiments, which are presented for purposes of illustration and not of limitation, and the present invention is limited only by the claims which follow.

What is claimed is:

1. A smoking filter comprising:

a first filter plug having:

a central core of a first filter material comprising web material, and a peripheral layer of a second filter material comprising fibrous tow surrounding said central core; wherein:

each of said central core and said peripheral layer has a resistance-to-draw, said central core having a resistance-to-draw of from about 285 mm W.G. to about 500 mm W.G. and said smoking filter having a resistance-to-draw of from about 115 mm W.G. to about 235 mm W.G., said peripheral layer having a lower resistance-to-draw than said central core, to initially direct, when said smoking filter is attached to a smoking article and said smoking article is smoked, a greater fraction of smoke through said peripheral layer than through said central core; said first filter plug further having:

means for admitting ventilation air through said peripheral layer toward said central core, whereby smoke initially directed into said peripheral layer flows back into said central core; whereby:

when said smoking filter is attached to a smoking article and said smoking article is smoked, said filtered smoking article delivers smoke containing a particular level of total particulate matter, and the taste of said smoking article is a taste associated with smoke having a level of total particulate matter higher than said particular level.

2. The smoking filter of claim 1 wherein said cellulose acetate tow has a denier per filament of about 8.0 and a total denier of about 30,000.

3. The smoking filter of claim 1 wherein said fibrous tow is cellulose acetate tow.

4. The smoking filter of claim 1 wherein said web material is paper.

5. The smoking filter of claim 4 wherein said web material is gathered corrugated web material.

6. The smoking filter of claim 5 wherein said paper is creped before being corrugated and gathered into said filter.

7. The smoking filter of claim 1 wherein said web material is a nonwoven web.

8. The smoking filter of claim 7 wherein said nonwoven web is cellulose acetate sheet.

9. The smoking filter of claim 1 wherein said gathered corrugated web material is wrapped in a plug wrap.

10. The smoking filter of claim 9 wherein said plug wrap is porous.

11. The smoking filter of claim 9 wherein said plug wrap contains flavor components.

12. The smoking filter of claim 11 wherein said plug wrap comprises plug wrap paper to which flavor components have been added.

13. The smoking filter of claim 1 having a filtration efficiency of about 61% measured as if unventilated.

14. The smoking filter of claim 1 having a ventilation rate of about 67%.

15. The smoking filter of claim 14 having a filtration efficiency of about 76%.

16. The smoking filter of claim 1 wherein said core has a cross-sectional area occupying about 60% of the total cross-sectional area of said smoking filter.

17. The smoking filter of claim 1 wherein:

said smoking filter has a resistance-to-draw of about 146 mm W.G.; and said central core has a resistance-to-draw of about 400 mm W.G.

18. The smoking filter of claim 1 wherein:

said smoking filter has a resistance-to-draw of about 135 mm W.G.;

said central core has a resistance-to-draw of about 370 mm W.G.

19. A smoking filter comprising:

a first filter plug having:

a central core of a first filter material, and a peripheral layer of a second filter material surrounding said central core, wherein:

one of said first and second filter materials is a fibrous tow and the other of said first and second filter materials is a gathered corrugated web material, each of said central core and said peripheral layer has a resistance-to-draw, said central core having a resistance-to-draw of from about 285 mm W.G. to about 500 mm W.G. and said smoking filter having a resistance-to-draw of from about 115 mm W.G. to about 225 mm W.G., said peripheral layer having a lower resistance-to-draw than said central core, to initially direct, when said smoking filter is attached to a smoking article and said smoking article is smoked, a greater fraction of smoke through said peripheral layer than through said central core, said first filter plug further having:

means for admitting ventilation air into said peripheral layer, whereby smoke initially directed into said peripheral layer flows back into said central core; and a second filter plug of cellulose acetate tow axially adjacent said first filter plug; whereby:

when said smoking filter is attached to a smoking article and said smoking article is smoked, said filtered smoking article delivers smoke containing a particular level of total particulate matter, and the taste of said smoking article is a taste associated with smoke having a level of total particulate matter higher than said particular level.

20. The smoking filter of claim 19 wherein:

said first filter material is said web material and said second filter material is said fibrous tow;

said first filter plug has a resistance-to-draw of from about 85 mm W.G. to about 175 mm W.G.;

said central core has a resistance-to-draw of from about 195 mm W.G. to about 450 mm W.G.; and said second filter plug has a resistance-to-draw of from about 10 mm W.G. to about 45 mm W.G;_ such that:

said smoking filter has a resistance-to-draw of from about 100 mm W.G. to about 180 mm W.G.

21. The smoking filter of claim 20 wherein:

said first filter plug has a resistance-to-draw of about 141 mm W.G.;

said inner core has a resistance-to-draw of about 267 mm W.G.; and said second filter plug has a resistance-to-draw of about 18 mm W.G.; such that:

said smoking filter has a resistance-to-draw of about 159 mm W.G.

22. The smoking filter of claim 19 wherein said first filter material is said web material and said second filter material is said fibrous tow.

23. The smoking filter of claim 19 further comprising tipping wrapped therearound, said tipping extending beyond a first end of said first filter plug for attaching said filter to a cigarette and extending beyond a second end of said second filter plug to form a mouth-end recess.

24. A smoking article, comprising, in combination:

a rod comprising tobacco, and a smoking filter as claimed in claim 19.

25. The smoking filter of claim 1 further comprising tipping wrapped therearound, said tipping extending beyond a first end of said first filter plug for attaching said smoking filter to a cigarette and extending beyond a second end of said first filter plug opposite said first end, forming a mouth-end recess in said smoking filter.

26. The smoking filter of claim 1 wherein said core and said peripheral layer are concentric.

27. The smoking filter of claim 1 wherein said web material is gathered corrugated web material.

28. The smoking filter of claim 1 having a ventilation rate between about 50% and about 76%.

29. The smoking filter of claim 28 wherein said fibrous tow is cellulose acetate tow.

30. A smoking article, comprising, in combination:

a rod comprising tobacco, and a smoking filter as claimed in claim 1.

31. A smoking filter comprising:

a first filter plug having:

a central core of a first filter material, a peripheral layer of a second filter material surrounding said central core, and tipping paper wrapped therearound, said tipping paper extending beyond a first end of said filter plug for attaching said smoking filter to a smoking article and extending beyond a second end of said first filter plug opposite said first end, forming a mouth-end recess in said smoking filter, wherein:

one of said first and second filter materials is a fibrous tow and the other of said first and second filter materials is a gathered corrugated web material;

each of said central core and said peripheral layer has a resistance-to-draw, said central core having a resistance-to-draw of from about 285 mm W.G. to about 500 mm W.G. and said smoking filter having a resistance-to-draw of from about 115 mm W.G. to about 235 mm W.G., said peripheral layer having a lower resistance-to-draw than said central core, to initially direct, when said smoking filter is attached to a smoking article and said smoking article is smoked, a greater fraction of smoke through said peripheral layer than through said central core; said first filter plug further having:

means for admitting ventilation air through said peripheral layer toward said central core, whereby smoke initially directed into said peripheral layer flows back into said central core; whereby:

when said smoking filter is attached to a smoking article and said smoking article is smoked, said filtered smoking article delivers smoke containing a particular level of total particulate matter, and the taste of said smoking article is a taste associated with smoke having a level of total particulate matter higher than said particular level.

32. A smoking article, comprising, in combination:

a rod comprising tobacco, and a smoking filter as claimed in claim 31.

33. A smoking filter comprising:

a first filter plug having:

a central core of a first filter material of fibrous material, and a peripheral layer of a second filter material of web material surrounding said central core; wherein:

each of said central core and said peripheral layer has a resistance-to-draw, said central core having a resistance-to-draw of from about 285 mm W.G. to about 500 mm W.G. and said smoking filter having a resistance-to-draw of from about 115 W.G. to about 235 mm W.G., said peripheral layer having a lower resistance-to-draw than said central core, to initially direct, when said smoking filter is attached to a smoking article and said smoking article is smoked, a greater fraction of smoke through said peripheral layer than through said central core; said first filter plug further having:

means for admitting ventilation air through said peripheral layer toward said central core, whereby smoke initially directed into said peripheral layer flows back into said central core; whereby:

when said smoking filter is attached to a smoking article and said smoking article is smoked, said filtered smoking article delivers smoke containing a particular level of total particulate matter, and the taste of said smoking article is a taste associated with smoke having a level of total particulate matter higher than said particular level.

34. The smoking filter of claim 33, wherein said fibrous tow is cellulose acetate tow.

35. The smoking filter of claim 34 wherein said cellulose acetate tow has denier per filament of about 1.6 and a total denier of about 35,000.

36. A smoking article, comprising, in combination:

a rod comprising tobacco, and a smoking filter as claimed in claim 33.

37. A smoking filter comprising:

a first filter plug having:

a central core of a first filter material, and a peripheral layer of a second filter material surrounding said central core; wherein:

one of said first and second filter materials is a fibrous tow and the other of said first and second filter materials is a gathered corrugated web material, wherein said web is a nonwoven web of cellulose acetate sheet;

each of said central core and said peripheral layer has a resistance-to-draw, said central core having a resistance-to-draw of from about 285 mm W.G. to about 500 mm W.G. and said smoking filter having a resistance-to-draw of from about 115 mm W.G. to about 235 mm W.G., said peripheral layer having a lower resistance-to-draw than said central core, to initially direct, when said smoking filter is attached to a smoking article and said smoking article is smoked, a greater fraction of smoke through said peripheral layer than through said central core; said first filter plug further having:

means for admitting ventilation air through said peripheral layer toward said central core, whereby smoke initially directed into said peripheral layer flows back into said central core; whereby:

when said smoking filter is attached to a smoking article and said smoking article is smoked, said filtered smoking article delivers smoke containing a particular level of total particulate matter, and the taste of said smoking article is a taste associated with smoke having a level of total particulate matter higher than said particular level.

38. A smoking article, comprising, in combination:

a rod comprising tobacco, and a smoking filter as claimed in claim 37.

39. A smoking filter comprising:

a first filter plug having:

a central core of a first filter material, and a peripheral layer of a second filter material surrounding said central core; wherein:

one of said first and second filter materials is a fibrous tow and the other of said first and second filter materials is a gathered corrugated web material, wherein said gathered corrugated web material is wrapped in a plug wrap containing flavor components;

each of said central core and said peripheral layer has a resistance-to-draw, said central core having a resistance-to-draw of from about 285 mm W.G. to about 500 mm W.G. and said smoking filter having a resistance-to-draw of from about 115 mm W.G. to about 235 mm W.G., said peripheral layer having a lower resistance-to-draw than said central core, to initially direct, when said smoking filter is attached to a smoking article and said smoking article is smoked, a greater fraction of smoke through said peripheral layer than through said central core; said first filter plug further having:

means for admitting ventilation air through said peripheral layer toward said central core, whereby smoke initially directed into said peripheral layer flows back into said central core; whereby:

when said smoking filter is attached to a smoking article and said smoking article is smoked, said filtered smoking article delivers smoke containing a particular level of total particulate matter, and the taste of said smoking article is a taste associated with smoke having a level of total particulate matter higher than said particular level.

40. A smoking article, comprising, in combination:

a rod comprising tobacco, and a smoking filter as claimed in claim 39.

41. The smoking filter of claim 39 wherein said plug wrap comprises plug wrap paper to which flavor components have been added.

* * * * *